United States Patent [19]

Reece et al.

[11] Patent Number: 4,674,781

[45] Date of Patent: Jun. 23, 1987

[54] ELECTRIC DOOR LOCK ACTUATOR

[75] Inventors: Ricky L. Reece, Starkville; Leland S. Byars; Larry S. Shannon, Sr., both of Columbus, all of Miss.

[73] Assignee: United Technologies Electro Systems, Inc., Columbus, Miss.

[21] Appl. No.: 809,377

[22] Filed: Dec. 16, 1985

[51] Int. Cl.[4] ..... E05C 13/00

[52] U.S. Cl. ..... 292/336.3; 292/DIG. 62; 292/201

[58] Field of Search ..... 292/336.3, 201, DIG. 62, 292/144

[56] References Cited

U.S. PATENT DOCUMENTS

| | | | |
|---|---|---|---|
| 1,304,955 | 5/1919 | Fowler | 292/DIG. 62 X |
| 3,243,216 | 3/1966 | Peters | 292/201 |
| 4,093,289 | 6/1978 | Inabayashi et al. | 292/336.3 |
| 4,102,213 | 7/1978 | Smith | 292/144 |
| 4,290,634 | 9/1981 | Gelhard | 292/201 |
| 4,459,834 | 7/1984 | Seki | 292/336.3 X |

*Primary Examiner*—Richard E. Moore

*Attorney, Agent, or Firm*—Robert P. Hayter

[57] ABSTRACT

An electric door lock actuator and door lock and latch mechanism are disclosed having manual and electric driven locking means. A combination of a lost motion coupling and resilient spring means for driving the motive means to a neutral position are utilized to effectively isolate the electric motor and gearing from the locking means such that the locking means may be operated manually without back-driving the electric motor and intermediate gearing. A specific rack defining a portion of the lost motion coupling together with a pair of springs mounted to engage a shoulder extending from a rack are disclosed to achieve the above function.

7 Claims, 5 Drawing Figures

ELECTRIC DOOR LOCK ACTUATOR

BACKGROUND OF THE INVENTION

The present invention is directed to an improvement in the design of an electric door lock actuator, particularly of the type used in an automobile to lock and unlock the latching bolts in the automobile door. More particulary, the present invention is directed to a combination lost motion and spring displacement device for disconnecting the electric door lock actuator from the locking mechanism of the door once the mechanism has moved to a position to secure the latch in the locked or unlocked position.

In most currently utilized electric door lock mechanisms the electric motor armature, gears and portions of the drive train are mechanically coupled to the locked mechanism. The typical system includes a latching bolt to secure the door to the frame of the automobile, an electric switch located on the inside of the door for locking or unlocking the bolt, a manually-displaceable handle inside of the door for unlatching the door, a manually-moveable button, slide or similar device for locking and unlocking a latching bolt in the door, and on the exterior of the door, a handle for latching and unlatching the door and a key opening for receipt of a key for unlocking or locking the latching bolts. The key-receiving mechanism may be designed to either manually unlock the latching bolts or to energize a motor to unlock the latching bolts. At this point in time, most key entry locks utilize the motion imparted by turning the key to unlock the latching bolts.

One of the problems identified with this type of system is that the manual effort required to turn the key to unlock the latching bolt may be significant. If the ambient temperature is low, or there is insufficient lubrication, or a key is particuarly weak, in any of of the above events, the force required to manually unlock the latching bolt may be such that the key is either twisted or broken in the process and entry to the car is denied.

It has been determined that one of the mechanisms acting to create the difficulty in manually unlocking the latching bolts in that when the electric motor, gears, and the remainder of the electric drive train to the door lock actuator are mechanically coupled thereto and in order to manually displace the latching bolt, it is necessary to "back-drive" the gear train and electric motor as the latching bolt is displaced. Hence, additional force on the key is required and additional work is necessary to accomplish the rotation of the motor armature and the displacement of the gear train of the actuator.

The term "back-driven" as used herein is a term used to define the physical movement including rotation of the armature of the actuator motor, and the intermediate gearing between the armature and the door locking mechanism upon manual displacement by turning a key to gain entry to an area.

It has also been identified that under emergency conditions there may be times when it is necessary to unlock a car door from the inside and it is desirable to have little or no parasitic loading due to back-driving. Such emergency conditions include an accident wherein the electrical power source, such as a battery, has become disconnected or the electric motor has been otherwise rendered inoperative. In these circumstances it is likewise beneficial not to have to manually back-drive the motor to accomplish unlocking of the vehicle door.

It is currently known in the art to utilize lost motion devices in door lock actuator units. For instance in U.S. Pat. No. 4,102,213 there is provided a lost motion connection to permit an actuator to cycle even if the door lock lever is being held to preclude movement. This device does not act to isolate manual operation from electric operation to avoid back-driving forces, but instead is directed as a safety feature so as not to destroy the door lock when a person manually holds the lock in a lock position when the unlock button is energized.

U.S. Pat. No. 4,290,634 discloses a series of devices for connecting the manual locking and unlocking button in a car to the motive means. A lost motion relationship is disclosed between items 63 and 62. Spring 64 is utilized to absorb excess energy from a flywheel. In FIGS. 3 and 4 there is disclosed a mechanism for connecting an electric motor to the gear train which is connected to the manual locking button where the gear train is engaged upon sufficient centrifugal force being applied by the motor being operated. Additionally, disclosed in FIGS. 5–8 is a separate type of lost motion device utilized without springs as is the device in FIGS. 9–12. A still further type of device is shown in FIGS. 13–15.

It is also currently known that at least one car manufacturer utilizes an electric door lock actuator which includes an electric motor which drives a rotating mechanism using a spring for latching and unlatching a door. This spring which is a direct part of the drive system is wound when the motor is energized such that when the motor is de-energized, the spring unwinds causing the motor to be rotated backwards thereby allowing for manual operation of the locking mechanism without being required to back-drive the motor.

SUMMARY OF THE INVENTION

It is an object of the present invention to provide an electric door lock actuator that provides for a lost motion coupling between electric motive means and a lock mechanism.

It is still a further object of the present invention to provide an electric door lock actuator having a combination of spring and lost motion device to displace the motor to a position where the lock may be manually operated without causing the motor to be back-driven.

It is another object of the present invention to provide an electric door lock and latch mechanism including electric means and manual means to lock and unlock said mechanism which allows for the manual means to be utilized without requiring the electric means to be back-driven.

Another object of the invention is to provide a safe, economical, reliable, easy to manufacture and utilize electric door lock actuator.

Other objects will be apparent from the description to follow and the appended claims.

The above objects are achieved according to a preferred embodiment by the provision of an electric door lock actuator for driving a door latch locking means which includes a reciprocally-driven rack means having a defined travel path, motive means for driving the rack means, spring means positioned to be compressed by the rack means toward the end of the rack means travel path, said spring means acting to displace the rack means from the end of the travel path when the motive means is not energized, a connecting member extending between the rack means and the door latch locking means, and said connecting member and rack means collectively forming a lost motion coupling, said coupling allowing the rack means to displace the connector to drive the door latch locking means and allowing the spring means to displace the rack means without displacing the connecting member or latch locking means.

Additionally, disclosed is a door lock and latch mechanism including manual means to lock and unlock said mechanism and electric means to lock and unlock said mechanism. The door lock and latch mechanism includes a means for connecting the electric means to the remainder of said mechanism in such a manner that the manual means for operating said mechanism may be utilized without the necessity of driving the electric means, said means for connecting including a lost motion coupling connecting the electric means and the remainder of the mechanism and a spring means positioned to cause relative motion in the lost motion coupling between the electric means and the mechanism whereby the manual means to lock and unlock the mechanism may be utilized to effect movement of the mechanism without causing the electric means to be displaced.

PREFERRED EMBODIMENT OF THE INVENTION

The invention herein will be described with reference to a specific lost motion coupling and to a specific means for compressing a pair of springs to effect the desired displacement of the electric motor. It is of course, to be understood that other types of lost motion couplings and other spring arrangements could be utilized in a similar manner to achieve the same function.

Figure 1:
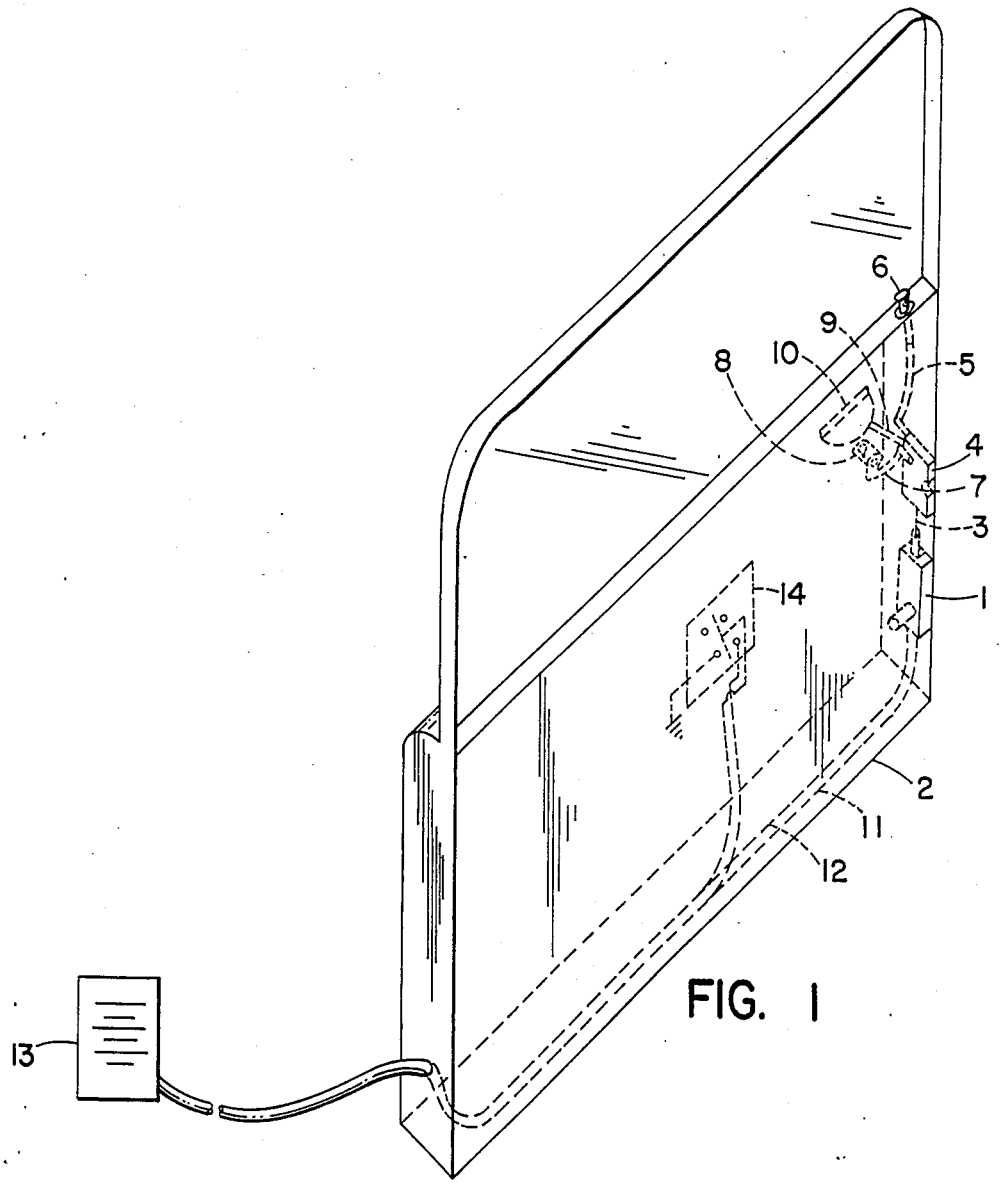
FIG. 1 is a perspective view of an automobile door showing the typical location of the door latch and lock mechanism, the electric door lock actuator and control switch, and circuit therefor.

Referring to FIG. 1, an electrically powered door lock actuator 1 is shown mounted between the inner and outer panels of an automobile door 2. A connecting link 3 extends from the actuator to a door latching and locking mechanism 4. The connecting link is driven back and forth by the actuator to engage and disengage the lock. A connecting rod 5 extends from the latch and lock mechanism to manual control button 6 located near the bottom edge of the window. This button is used to manually lock and unlock the door latching mechanism. A connecting rod 7 extends from the latch and lock mechanism to the key operated actuator 8 that is accessible from outside the door. A connecting rod 9 extends from the latch and lock mechanism to the door handle 10 that is used to unlatch the door.

Conductors 11 and 12 supply current to the actuator from a battery 13 through a double pole, double throw control switch 14 located on the inner panel of the door. The arrangement of the various elements just described can be considered typical for an automobile door although slight variations in location of the components may vary from one type automobile to another. Almost without exception, however, there will be a means to manually latch a door from inside and outside the door, and a manual means to lock and unlock the latching means that will be located inside the door and outside the door. In automobiles that have electric door lock actuators, the electric actuator is mounted within the door and is connected by linkage to the manually actuated locking mechanism. The control switch for the electric actuator is mounted inside the automobile and is usually located on the inside panel of the door. Also, on some later model automobiles, an electrical switch is also incorporated in the key actuator so that when a key is inserted in the slot, a switch is closed which causes the electric actuator to unlock the latch.

FIGS. 2–5 show a detailed view of the electric door lock actuator in accordance with the present invention. The objective of the invention is to overcome a problem common on heretofore known systems. The problem centers around the fact that, because the electric actuator and the manual control for the lock are both connected to the same mechanism, increased physical force is required to unlock the latch simply because the electric actuator has to be "back-driven".

In accordance with the invention as set forth in FIGS. 2–5, once the electric actuator has accomplished its mission of either locking or unlocking the door latch, it effectively disengages itself from the locking mechanims until such time as it is engaged to perform another function. Thus, the manual lock controls are much easier to operate since no back-drive of the electrical actuator is required.

Figure 2:
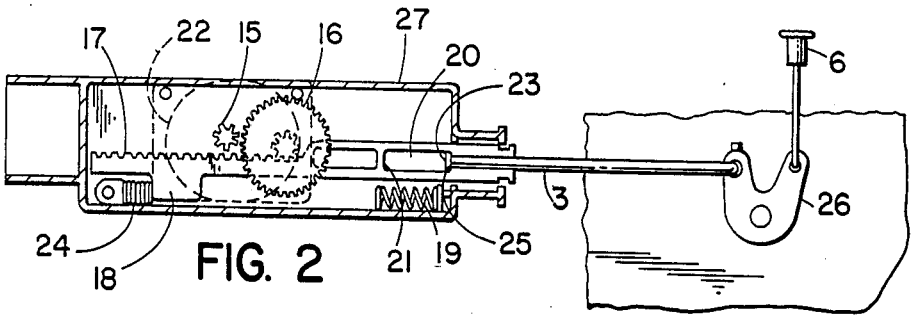
FIG. 2 is a sectional view of the electric door lock actuator in accordance with the present invention showing the position of the components of the actuator at the extreme left range of travel.

In FIG. 2, pinion 15 is driven by a reversible motor 22. The pinion meshes with gear 16 that, in turn, meshes with rack gear 17 so that, as the motor driven pinion rotates in the clockwise direction, the rack will move to the right as viewed and to the left when the pinion rotates in a counterclockwise direction. As the rack gear moves to the right, a shouldered section 18 of the rack gear engages spring 19 and compresses the spring against housing 27 as the rack travels toward the right.

Attached to the right end of the rack is a connecting link 3 that is secured within a cavity defined by the rack but that is free to move laterally with respect to the rack within predetermined limits. The freedom for the limited lateral movement is accomplished by means of a headed over section 23 of the connecting link that is free to move within cavity 20 provided in the rack that serves to contain, guide and limit the freedom of lateral movement of the link with respect to the rack. It is anticipated that this freedom of movement could be provided at some other location. For example, there could be an elongated slot provided on the member of the lock mechanism into which the connecting link attaches that would provide limited movement of the locking mechanism with respect to the connecting link, and this would effectively accomplish the same objective.

A complete operating cycle of the actuator can be followed by viewing FIGS. 2–5 wherein like components in each figure are identified by the same number. In FIG. 2, the actuator is fully extended to the left as viewed, and motor 22 is energized. For the sake of explanation, this position will be assumed to place the door lock in an unlocked position. As viewed here, motor 22 has already driven the rack gear 17 to the position and spring 24 is fully compressed. The head over portion of connecting link 3 is positioned against the right wall 25 of cavity 20. As a result of the rack gear moving to the left causing the headed over portion of the connecting link to contact wall 25 of cavity 20 at which time the connecting link then moved to the left with the rack thereby moving lock actuator arm 26 to the unlocked position as shown.

Figure 3:
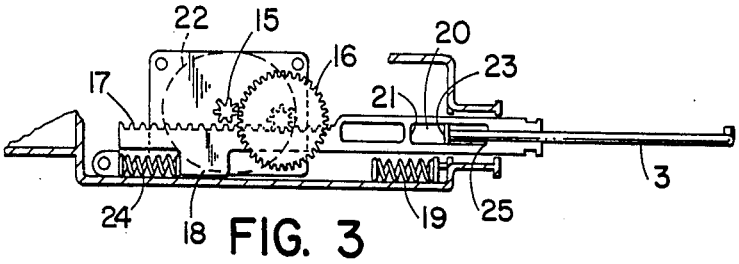
FIG. 3 is a sectional view of the electrical door lock actuator in accordance with the present invention showing the position of the components as the actuator is returned to a neutral position.

FIG. 3 shows the position of the components after the control switch 14 is released, and motor 22 is no longer energized. In this view, spring 24 has forced the rack gear 17 to move to the right as compared to the position in FIG. 2. This has caused the right wall 25 of cavity 20 to move away from headed over section 23. Now the manual control lock button 6 can be moved to the locked or unlocked position without moving rack gear 17 because the headed over section 23 of connecting link 3 is free to move within cavity 20. In the position as shown, the manual mechanism is effectively disconnected from the electrical actuator.

Figure 4:
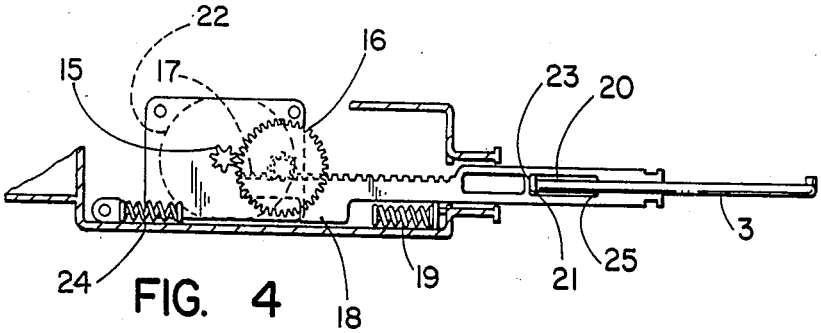
FIG. 4 is a sectional view of the electrical door lock actuator in accordance with the present invention showing the position of the components as the actuator is travelling to the right.

In FIG. 4, the control switch 14 has just been energized and motor 22 has begun to move the rack gear to the right or locked position. The headed over section 23 of connecting link 3 has come to rest against left wall 21 of cavity 20, but spring 19 has not yet been compressed by shouldered section 18 of the rack gear 17.

Figure 5:
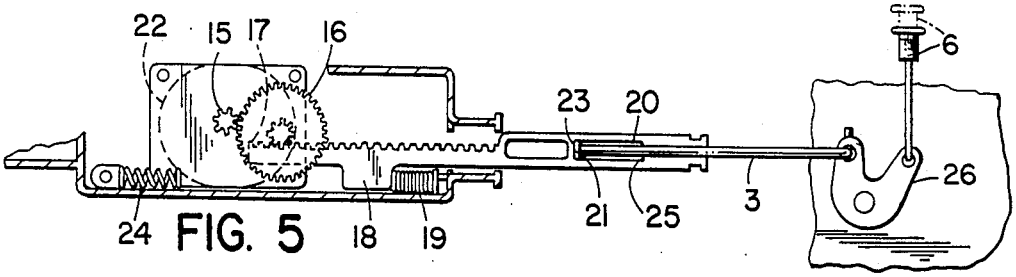
FIG. 5 is a sectional view of the electrical door lock actuator in accordance with the present invention showing the position of the components of the actuator at the extreme right range of travel.

In FIG. 5, the actuator is fully extended to the right and motor 22 is still energized. Also, the lock actuator arm has been rotated in a clockwise direction to lock the latch mechanism. When the control switch is released, compressed spring 19 will force the rack gear 17 to fhe left, thereby returning the actuator to the condition as shown in FIG. 3. Hence, again, the actuator is effectively disconnected from the latching and locking mechanism. As a result, the manual control button 6 may be manipulated without back-driving the actuator. Also, the key locking and unlocking feature, the connecting rod 7 of which is also attached to the latching and locking mechanism, may be manipulated without back-driving the motor.

The invention has been described with reference to a particular embodiment but it will be understood by those skilled in the art that variations and modifications can be effected within the spirit and scope of the invention.

We claim:

1. An electric door lock actuator including a door latch locking means which comprises:

a reciprocally driven rack means including a shouldered section having a defined travel path;

a housing having the rack means mounted therewithin;

motive means for driving the rack means;

spring means mounted within the housing and positioned to be compressed by the shouldered section of the rack means toward the end of the rack means travel path, said spring means acting to displace the rack means from an end of the travel path when the motive means is not energized;

a connecting member extending between the rack means and the door latch locking means; and said connecting member and rack means collectively forming a lost motion coupling, said coupling allowing the rack means to displace the connecting member to drive the door latch locking means and allowing the spring means to displace the rack means without displacing the connecting member or latch locking means.

2. The apparatus as set forth in claim 1 wherein the motive means is a bidirectional electric motor.

3. The apparatus as set forth in claim 1 wherein the lost motion coupling further comprises the rack means defining a lost motion cavity and the connecting member including an expanded diameter end which slides within the lost motion cavity whereby the rack means and connecting member may be displaced relative to each other by allowing sliding movement between the rack means and the connecting member.

4. The apparatus as set forth in claim 1 wherein the spring means further comprises a first spring and a second spring, one spring located at each end of the housing, and wherein the shouldered section of the rack means engages and compresses the appropriate spring as the rack means travels to either end of its travel path.

5. A door lock and latch mechanism latching manual means to lock and unlock said mechanism and electric means to lock and unlock said mechanism comprising:

means for connecting the electric means to the remainder of the mechanism in such a manner that the manual means for operating said mechanism may be utilized without the necessity of driving the electric means, said means for connecting including, a rack means mounted for reciprocal movement in the housing and including a shouldered section, spring means secured within the housing such that the shouldered section of the rack means engages the spring means to compress the spring means as the rack travels towards one end of its travel path, a lost motion coupling connecting the rack means and the remainder of the mechanism, and wherein said spring means acts to cause relative motion in the lost motion coupling between the electric means and the mechanism whereby the manual means to lock and unlock the mechanism may be utilized to effect movement of the mechanism without causing the electric means to be displaced.

6. The apparatus as set forth in claim 5 wherein the lost motion coupling further comprises a lost motion cavity defined by the rack means and an expanded diameter end of the connecting member which is mounted and slides within the lost motion cavity thereby allowing limited relative displacement between the rack means and the connecting member.

7. The apparatus as set forth in claim 5 wherein the spring means further comprises a first spring and a second spring, one spring located at each end of the housing, and wherein the shouldered section of the rack means engages and compresses the appropriate spring as the rack means travels to either end of its travel path.

* * * * *

UNITED STATES PATENT AND TRADEMARK OFFICE

CERTIFICATE OF CORRECTION

PATENT NO. : 4,674,781

DATED : June 23, 1987

INVENTOR(S) : Ricky L. Reece, Leland S. Byars, Larry S. Shannon, Sr.

It is certified that error appears in the above-identified patent and that said Letters Patent is hereby corrected as shown below:

Column 6, line 28, after "mechanism" please delete "latching" and insert --including--

Signed and Sealed this

Fourteenth Day of February, 1989

*Attest:*

DONALD J. QUIGG

*Attesting Officer*

*Commissioner of Patents and Trademarks*